US006725592B2

(12) United States Patent
Reed

(10) Patent No.: US 6,725,592 B2
(45) Date of Patent: Apr. 27, 2004

(54) NON-INTEGRAL FIREARM SAFETY LOCK

(76) Inventor: Waymon Burton Reed, P.O. Box 492, Pottsboro, TX (US) 75076

( * ) Notice: Subject to any disclaimer, the term of this patent is extended or adjusted under 35 U.S.C. 154(b) by 0 days.

(21) Appl. No.: 10/223,740

(22) Filed: Aug. 20, 2002

(65) Prior Publication Data

US 2004/0035042 A1 Feb. 26, 2004

(51) Int. Cl.[7] ..... F41A 17/02; F41A 17/44
(52) U.S. Cl. ..... 42/70.11
(58) Field of Search ..... 42/70.01, 70.11

(56) References Cited

U.S. PATENT DOCUMENTS 4,995,180 A * 2/1991 Tucker et al. ..... 42/70.07
5,419,069 A * 5/1995 Mumbleau et al. ..... 42/70.11
5,669,252 A * 9/1997 Bentley ..... 42/70.11
5,918,402 A * 7/1999 Weinraub ..... 42/70.07
6,499,244 B1 * 12/2002 Smith et al. ..... 42/70.11

FOREIGN PATENT DOCUMENTS

GB 2 044 417 A * 10/1980

* cited by examiner

*Primary Examiner*—Stephen M. Johnson

(57) ABSTRACT

The present invention is a non-integral firearm safety lock that is inserted into a firearm's firing chamber ejector and loading port, expands and locks, thus prevents the weapon from being fired. The non-integral firearm safety lock is designed to fit most open chamber firearms. Once the firearm safety lock is inserted into the firearm's open chamber a key is used to expand a locking plate that is forced downward, fills and seals the loading port which disables the weapon. The distinct difference of this particular safety device from other safety devices is that it is user friendly and takes only seconds to install and remove. The non-integral firearm safety lock, when installed, fits flush with the weapon's frame that greatly enhances the cosmetic appearance of a firearm. The non-integral firearm safety lock is easy to manufacture and is inexpensive.

2 Claims, 4 Drawing Sheets

NON-INTEGRAL FIREARM SAFETY LOCK

CROSS-REFERENCE TO RELATED APPLICATIONS

Not applicable.

STATEMENT REGARDING FEDERALLY SPONSORED RESERCH OR DEVELOPMENT

Not applicable.

REFERENCE TO A MICROFICHE APENDIX

Not applicable.

BACKGROUND OF THE INVENTION

This invention relates to a firearm safety device that is positioned inside the firing chamber of a weapon and locked for the purpose of preventing children and unauthorized users from firing a firearm.

There is a social backlash against guns. The gun industry faces allegations that its products are unsafe. There are campaigns aimed at keeping guns safe around children. Hunters and target shooters are accidentally injured by their weapon discharging. Education and training classes are being conducted to familiarize gun users about how to properly handle guns and about gun safety. Guns are exempt from federal consumer safety regulations.

Government agencies are working diligently to pass new laws that will help regulate gun safety devices. Government tests to defeat firearm safety devices are being conducted. The purpose of these tests is to disable the firearm safety device thereby rendering the firearm capable of firing. Firearm safety devices presently on the market were tested using common household tools. Considered, as household tools were screwdrivers, pipe and crescent wrenches, vice grip pliers, other pliers, hacksaws, crowbars, electric and cordless drills, cigarette lighters, hammers and chisels.

There are hundreds of firearm safety devices. Many of these devices are attached to a weapon's trigger guard and enclose the trigger. A person not authorized to use the weapon would not have access to the weapon's trigger.

Two such gun trigger-blocking locks are described in U.S. Pat. No. 5,918,402, to Weinraub and U.S. Pat. No. 5,487,234, to Dragon, show keyed locking devices that enclose the firearm's trigger. These trigger locks are a deterrent for an unauthorized user. However, many of the materials used to manufacture these trigger locks are made from rubber and plastic. Rubber and plastic are highly flammable. Using a common household match or a cigarette lighter can disable most all trigger locks.

Other type firearm safety devices are placed in the weapon's firing chamber. The device is then rotated to expand against the interior walls of the firing chamber barrel; thus, the firearm cannot be loaded with live ammunition.

U.S. Pat. No. 3,193,959, to Jaycox, U.S. Pat. No. 5,054,223, to Lee, U.S. Pat. No. 5,950,344, to Ross and U.S. Pat. No. 2,530,560, to Young, show firearm safety devices that are placed in a weapon's firing chamber and expanded to create an interference fit, thereby, rendering the weapon useless.

Some firearm firing chamber locks require a key for their removal. Other locks may require rods to dislodge the lock from the firing chamber so it can be removed.

Firearm chamber locks give a false sense of security. Most all weapon's are heavily oiled, inside and outside, with gun oil. Once the firearm firing chamber lock is placed in the weapon's firing chamber, and a key placed inside the lock, the key cannot be turned or expanded enough to maintain traction. A metal rod, larger than a cleaning rod, placed inside the barrel, and using a downward, striking motion will dislodge the firearm firing chamber lock. The gun oil will not allow traction for the firearm firing chamber lock against the firing chamber wall.

Other firearm safety devices commonly used are firearm safety cable locks. These cable locks are usually applied by looping a cable through the weapon's shell loading and shell ejection port. Once the cable lock is installed the weapon is useless and the weapon cannot be fired.

U.S. Pat. No. 5,233,777, to Waterman, shows a firearm lock assembly that extends between a chamber insert and a muzzle cap. The cable is locked by an armature extension of a lock, which has a catch for receiving a lug fixed to the cable. U.S. Pat. No. 6,385,889, to Zaharek, shows a gunlock assemble that consist of two major components, a chamber blocking rod member and a locking rod member. Prior art shows that a thief or an unauthorized user could conceivably disarm these firearm safety lock assemblies by utilizing a common household hacksaw or a file. Open exposures will allow the use of a screwdriver for prying and bending the locking devices.

Using pliers or grips easily disarms firearm safety cable locks. By placing open pliers where the cable enters the lock, and applying pressure to the pliers handles, and using a twisting motion, back and forth, the lock will break where the cable is attached to the stanchion. The firearm safety cable lock is then disarmed.

U.S. Pat. No. 5,410,832, to Barnhart, shows a weapon chamber safety plug kit. The weapon chamber safety plug kit is a safety device, when placed in a weapon's firing chamber, allows a person to visually observe an exposed safety tab which indicates the weapon does not have live ammunition in the firing chamber. The weapon chamber safety plug is only a safety indicator. The plug is easy to remove and the weapon is then ready to be loaded and fired.

REFERENCES CITED

| U.S. Patent Documents | | | |
|---|---|---|---|
| 5487234 | Jan., 1996 | Dragon | 42/70.07 |
| 5918402 | Jul., 1999 | Weinraub | 42/70.07 |
| 3193959 | Jul., 1965 | Jaycox | 42-1 |
| 5054223 | Oct., 1991 | Lee | 42/70.11 |
| 5950344 | Sep., 1999 | Ross | 42/70.11 |
| 5233777 | Aug., 1993 | Waterman | 42/70.11 |
| 6385889 | May, 2002 | Zaharek | 42/70.11 |
| 5410832 | May, 1995 | Barnhart | 42/70.11 |

DISCLOSURE OF THE INVENTION

The present invention is a non-integral firearm safety-locking device. The locking device is rectangular and fits into a weapon's empty chamber cavity. This locking device is put to use by locking a weapon's bolt to the rear. When moving the bolt to the rear it causes the weapon to extract loaded ammunition and will expose the weapon's empty chamber. Only a keyed faceplate is visible when the lock is in place. The outer face of the firearm safety lock is flush with the weapons outer chamber frame. The locking device end nearest the bolt rests on the end of the weapon's barrel. This prevents the weapon from being disassembled to remove the lock. The backside of the firearm safety device is designed to house a finger lock that provides a backup barrel lock. Also, this prevents the weapon from being disassembled. The firearm safety lock end nearest the firing chamber prevents the firearm safety lock from being used when the weapon is loaded. The bottom of the firearm safety lock has a movable metal plate that protrudes into the ammunition loading port of the firearm when in the locked position. To place the device in a locked mode the key is inserted into the non-integral firearm safety lock's keyed entry and rotated ninety degrees counter-clockwise. This motion moves the locking plate down and into the firing chanber shell loading port and locks the weapon. Once locked, the weapon cannot be fired, loaded, unloaded or disassembled. To remove the firearm safety lock insert the key into the non-integral firearm safety lock's keyed entry and rotate clockwise ninety degrees and lift the lock out of the firing chamber. The key is used for a lift handle. Once the safety lock is removed the firearm is ready to be loaded and fired. Each of the non-integral firearm safety-locking devices is keyed differently. The non-integral firearm safety-locking device provides an extremely safe and fast method for securing a firearm. The device is designed to allow quick access to the weapon for quick loading and firing. The non-integral firearm safety lock is very affordable. The price for the non-integral firearm-safety device will be competitive with other gun safety locks sold today.

BRIEF SUMMARY OF THE INVENTION

It is an object of the invention to provide a safe, fast and economical method for placing a firearm in an inoperable mode until the weapon is ready for use.

Another object of the invention is to provide a non-integral firearm safety lock to the general public that is user-friendly.

Another object of the invention is to have a non-integral firearm safety lock that has passed the scrutiny of testing laboratories.

Another object is to provide a non-integral firearm safety lock that is installed and removed within seconds by the use of a key that is keyed differently.

Another object is to provide a non-integral firearm safety lock that cannot be removed from a weapon by using normal household tools.

Another object is to provide gun manufacturers, wholesalers, retailers, customers and gun users a safe and inexpensive method for transporting and storing their weapons.

Another object is to provide a firearm safety lock that is tamper proof for children and unauthorized users.

Another object is to provide a firearm safety device that prohibits installing the non-integral firearm safety lock into a weapon that is loaded with live ammunition.

Another object is to provide a non-integral firearm safety lock that cannot be removed by the use of a rod inserted into a weapon's barrel.

Another object is to provide a non-integral firearm safety lock that prohibits disassembling a locked weapon.

BRIEF DESCRIPTION OF THE DRAWINGS

A more detailed understanding of the present invention may be had by reference to the following detailed description when taken in the drawings wherein.

DETAILED DESCRIPTION OF THE DRAWINGS

Figure 1:
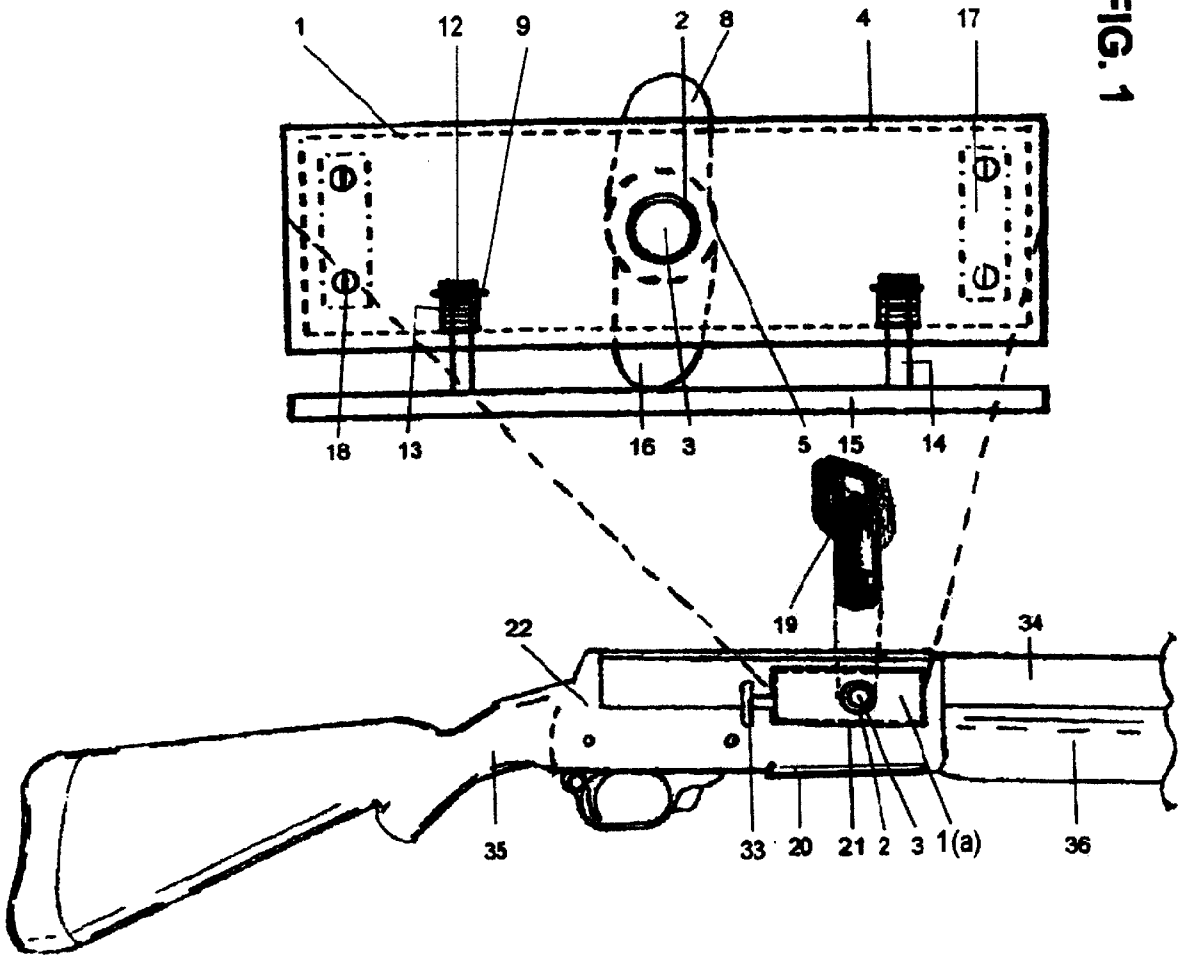
FIG. 1 is a view of the non-integral firearm safety lock and circular key, before and after being positioned in a weapon's firing chamber.

There are five major operational parts to the non-integral firearm safety lock 1. (1) lock frame 4, (2) cover plate 1(*a*), (3) cam lock 3, (4) lock plate 15 and (5) key 19.

FIG. 1 depicts an enlarged, non-integral firearm safety lock 1 in an elevated position before being placed in the firing chamber 21 of a weapon 22. Beneath, the non-integral firearm safety lock 1, is a demonstration of the non-integral firearm safety lock 1 locked into the weapon's 22 firing chamber cavity 21.

The non-integral firearm safety lock 1 is a rectangular firearm lock that has dimensions equal to, or minutely less, than a weapon's firing chamber cavity 21.

A top view of the non-integral firearm safety lock 1, as shown in FIG. 1., displays the operational functions of the locking device.

Using the key 19, and placing it into the keyed entry 2 and cam lock 3 and rotating the cam lock 3 and cam 26 counter-clockwise ninety degrees, will move the lock lever 16 against the lock plate 15 that moves the lock plate 15 downward into the lock position. Also, moves the barrel latch 8 upward and into an opening in the barrel 34 and will prevent the firearm 22 from being disassembled. The barrels in open firing chamber weapons extend along the backside of the firing chamber from front to rear. The barrel latch 8 may or may not be used depending on the type or size of the firearm. When in the locked position lock plate 15 protrudes below and inside the firing chamber's open shell loading port 21 thereby, completing the lock cycle. On opposite ends of the Lock plate 15 there are two lock plate guides 14. Mounted on each lock plate guide 14 are a tapped guide screw 12, a washer 9, and a tension spring 13. When lock plate 15 is positioned in the locked position spring(s) 13 hold tension against the jock plate guide 14 and the interior wall of the frame 4. By inserting key 19 into keyed entry 2 and turning cam lock 3 ninety degrees clockwise will allow cam lever 16 to release tension on lock plate 15 thereby, moving lock plate 15 to the unlocked position. In the unlocked position grasp key 19 and lift to remove the non-integral firearm safety lock from the weapon's firing chamber 21. Key 19 is removable from keyed entry 2 in the locked position only.

Figure 2:
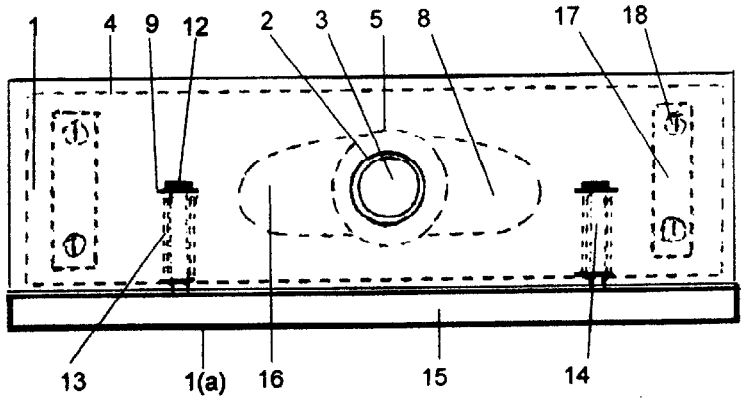
FIG. 2 is a top view of the non-integral firearm safety lock in the unlocked position.

FIG. 2 is a view of the non-integral firearm safety lock 1 in the unlocked position. Lock lever 16 has been rotated clockwise to the unlocked position that released tension on spring(s) 13 thereby, pressuring locking plate 15 against frame 4 which allows key 19 to lift the non-integral firearm safety lock 1 from the firing chamber 21. Cover plate frame support(s) 17 are positioned on each end of frame 4. The cover plate 1(*a*) is attached by screw(s) 18. The non-integral firearm safety lock 1 may be used with various style covers. Cover designs depend on the configuration of a particular weapon's open entry to its firing chamber. Most all firearms have dissimilar firing chamber openings. The non-integral firearm safety lock may be manufactured in one piece for a particular shape, size or brand firearm. Manufacturing for a particular firearm could eliminating the use of a separate cover plate 1(*a*), screw(s) 18 and the cover plate frame support(s) 17.

Figure 3:
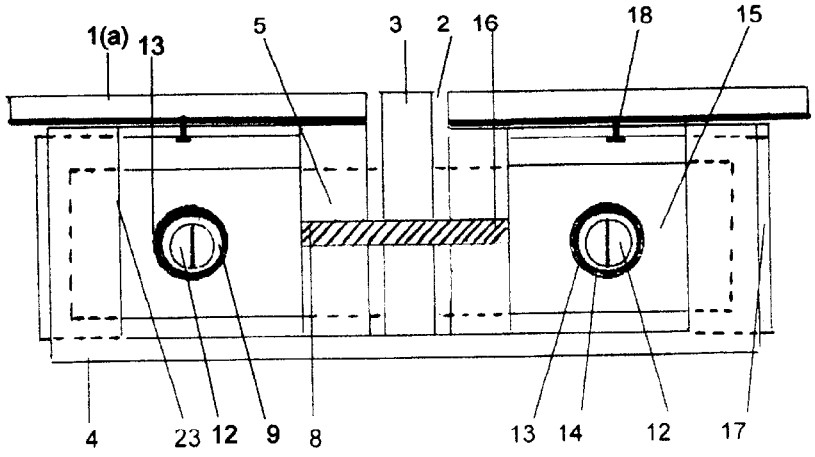
FIG. 3 is a side view of the non-integral firearm safety lock outlining the cover plate, keyed entry, lock plate and extruded frame.

FIG. 3 is a back view of the non-integral firearm safety lock.1. 1(*a*) is shown attached to frame 4 by screw(s) 18. The cam lock 3 and keyed entry 2 show the placement and position of lock lever 16, barrel latch 8 and latch plate 15. On each end of lock plate 15 are shown the lock guide(s) 14, tension spring(s) 13, washer(s) 9 and guide screw(s) 12.

Figure 4:
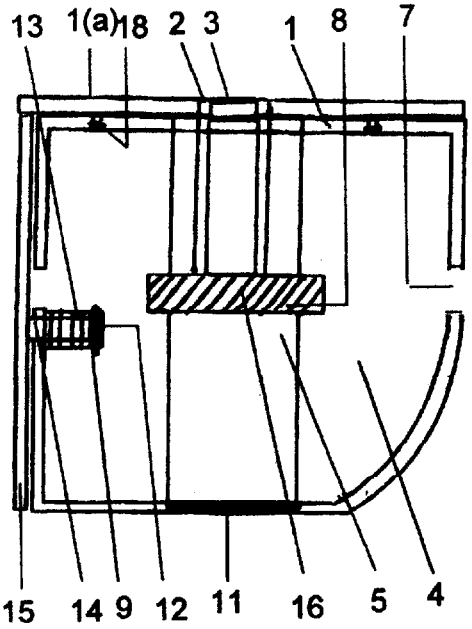
FIG. 4 is a end view of the non-integral firearm safety lock outlining the cover plate, keyed entry, lock plate and extruded frame in the unlocked position.

FIG. 4, is a sectional view of the non-integral firearm safety lock nearest the barrel end of the firing chamber. FIG. 4 depicts a non-integral firearm safety lock in the unlocked position. The cam lock 3 and keyed entry 2 show the placement and position of lock lever 16 and latch plate 15. Latch plate 15 is pressured against frame 4 by the tension spring(s) 13. While in this unlocked position the lock 1 is ready to be placed into the weapon's firing chamber 21, and locked. The extruded frame 4 allows freedom for lock lever 16 to press against the lock plate 15 which moves it downward and locked into the weapons firing chamber shell loading port 21. The extruded frame 4 allows freedom for the barrel latch 8 to be moved out and upward and locks the barrel 34. The firearm cannot be disassembled once the barrel is latched. Further, lock 1 shows the keyed entry 2 in relationship to the frame 4, lock housing 5, lock lever 16 and barrel latch 8.

Figure 5:
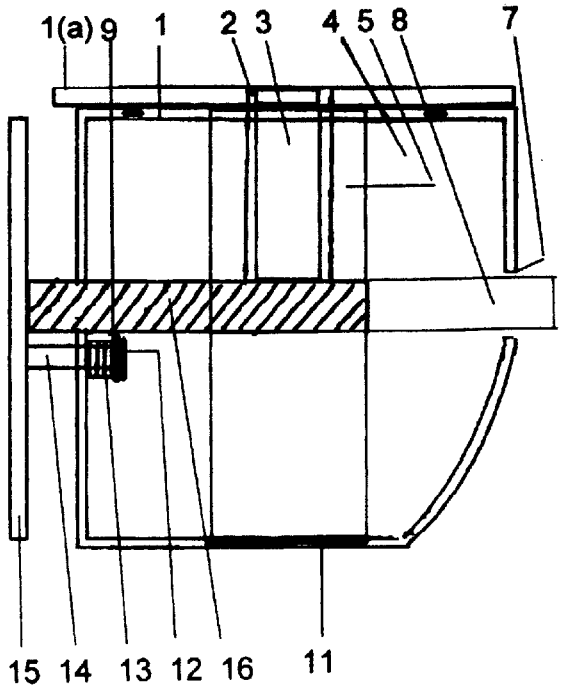
FIG. 5 is a end view of the non-integral firearm safety lock outlining the cover plate, keyed entry, lock plate and extruded frame in the locked position.

FIG. 5 is sectionals view of the non-integral firearm safety lock nearest the barrel end of the firing chamber. FIG. 5 depicts a non-integral firearm safety lock in the locked position. Key 19 was placed into the keyed entry 2 and rotated cam lock 3 counter-clockwise ninety degrees thus pressing lock lever 16 outwardly against the lock plate 15. The non-integral firearm safety lock is then in the locked position. These motions have moved the lock guide(s) 14 outward and the washer(s) 9 and guide screw(s) 12 have compressed the tension spring(s) 13 against the interior walls of frame 4, that completes the lock cycle. Also, the barrel latch 8 has secured the barrel 34 therefore, the firearm cannot be disassembled.

Figure 6:
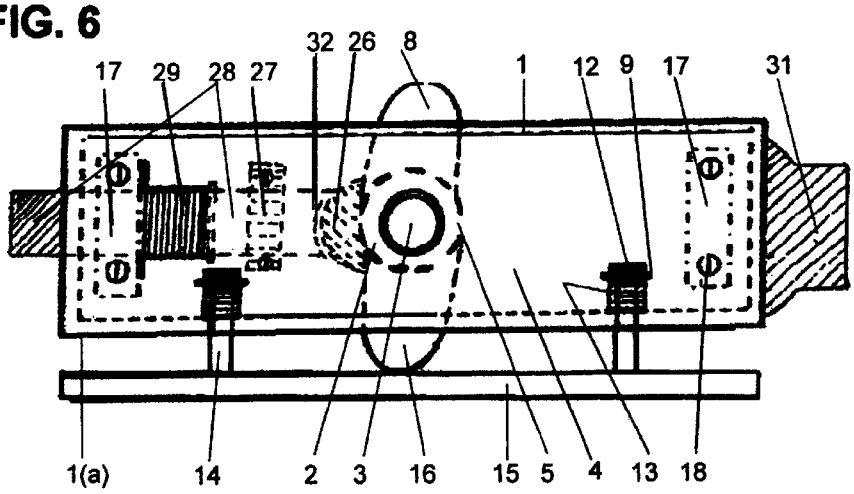
FIG. 6 is a top view of the non-integral firearm safety lock in the locked position outlining the cover plate, keyed entry, cam lock, lock plate, bolt latch and firing chamber plug.
Figure 7:
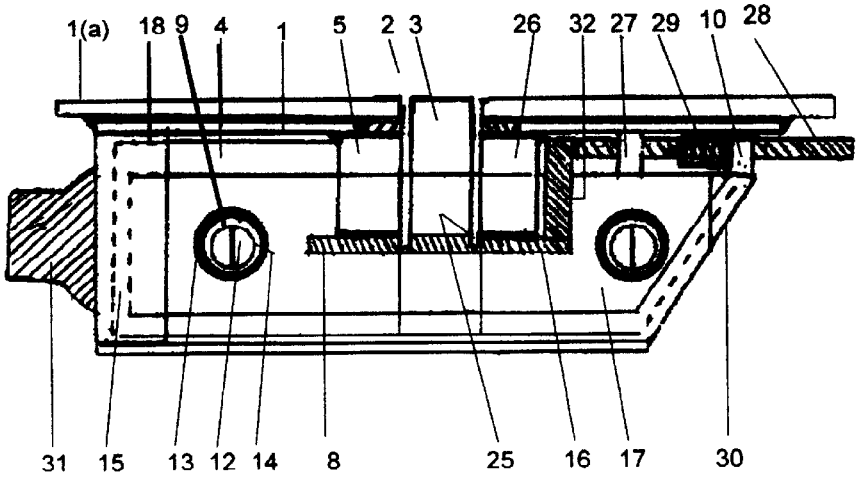
FIG. 7 is a side view of the non-integral firearm safety lock outlining the cover plate, keyed entry, cam lock, lock plate, bolt latch and firing chamber plug.

FIG. 6 and FIG. 7 are shown to display added features to lock 1 shown in FIG. 1. These added features might be required for a different make or model firearm. The added features include a cam operated bolt latch 28, an enlarged firing chamber barrel plug 31 and a tapered end 30 that faces the bolt 33. The functions of lock 1 described in FIG. 1 are not repeated in the FIG. 6 and FIG. 7. Only the added features are described.

FIG. 6 drawing show lock 1, which supports a cam 26 that maneuvers bolt latch 28 between the firearm's frame 4 and firearms bolt 33. Situate the unlocked lock 1 into the firearm's firing chamber. Place key 19 into the keyed entry 2 and lock 1(*a*), turn lock 1(*a*) counter-clockwise 90 degrees. This motion rotates cam 26 into and against cam lever 32 that moves bolt latch lever 28 into the locked position one quarter inch between the frame 4 edge and the top side of the bolt 33.

What is claimed is:

1. A non-integral firearm safety lock for a weapon having a frame, bolt, firing chamber port, loading port and barrel, said lock comprising:

a generally rectangular frame dimensioned to fit snuggly in the firing chamber port; and a movable locking plate attached to the fame, said locking plate moveable between a locked position and an unlocked position, said locking plate being moved into the loading port when in the locked position.

2. A non-integral firearm safety lock as claimed in claim 1 further comprising:

keyed cam lock to move the locking plate between the locked and unlocked position and to secure the locking plate once in the locked position.

* * * * *